United States Patent [19]

Bielfeldt

[11] Patent Number: 5,025,652

[45] Date of Patent: Jun. 25, 1991

[54] COLLET SURFACE STRUCTURE FOR A HYDRAULIC HIGH-SPEED PRESS

[75] Inventor: Friedrich B. Bielfeldt, Eppingen, Fed. Rep. of Germany

[73] Assignee: Maschinenfabrik J. Dieffenbacher GmbH & Co., Eppingen, Fed. Rep. of Germany

[21] Appl. No.: 422,554

[22] Filed: Oct. 17, 1989

[30] Foreign Application Priority Data

Oct. 17, 1988 [DE] Fed. Rep. of Germany ..... 3835298

[51] Int. Cl.[5] ..... B21J 7/46

[52] U.S. Cl. ..... 72/444; 72/446; 72/453.04; 72/454

[58] Field of Search ..... 72/455, 456, 444, 453.02, 72/453.06, 453.08, 446, 453.03, 453.04; 100/269 R, 269 B, 214

[56] References Cited

U.S. PATENT DOCUMENTS

| | | | |
|---|---|---|---|
| 3,735,631 | 5/1973 | Schmoll et al. | 72/453.08 |
| 4,123,929 | 11/1978 | Huydts | 72/453.08 |
| 4,291,571 | 9/1981 | Claussen | 72/455 |
| 4,809,535 | 3/1989 | Ellis | 72/444 |

FOREIGN PATENT DOCUMENTS

| | | | |
|---|---|---|---|
| 3637544 | 5/1988 | Fed. Rep. of Germany . | |
| 3637545 | 5/1988 | Fed. Rep. of Germany . | |
| 0297602 | 11/1936 | Italy | 72/453.02 |
| 2198078 | 6/1988 | United Kingdom . | |
| 2224971 | 5/1990 | United Kingdom . | |

*Primary Examiner*—David Jones

*Attorney, Agent, or Firm*—Foley & Lardner

[57] ABSTRACT

A collet surface structure is provided for a high-speed hydraulic press having collet interlock in order to eliminate leakage of oil into the clamping region. Furthermore, the formation of a harmful hydrostatic film thickness from the lubricating-oil film between the pressure rods and the collets is prevented, since the oil is immediately forced away due to the high clamping pressure between the clamping faces. These high clamping pressures result from the extremely short space of the lubricating-oil elimination grooves and the large capacity of the grooves. Thus, the oil-eliminating grooves are made large enough to eliminate reliably a hydrostatic oil film of at least 0.1 mm. This regularity is independent of the clamping diameter of the collet.

10 Claims, 4 Drawing Sheets

COLLET SURFACE STRUCTURE FOR A HYDRAULIC HIGH-SPEED PRESS

BACKGROUND OF THE INVENTION

1. Field of the Invention

The invention relates to collet surface structures, and more particularly, to a collet surface structure which eliminates leakage-oil on the hydraulic clamping system of an hydraulic highspeed press.

2. Discussion of the Related Art

Hydraulic high-speed presses are well known, for example, from German Offenlegungsschrift 3,637,544 German Offenlegungsschrift 3,637,545. By means of a special construction and control employed in these presses, a virtually jolt-free and wear-free coupling is obtained. Specifically, these presses use a non-positive clamping under low effective masses of the pressure rods synchronously with the movement of the press. This is made possible by hydraulic damping and automatic compensation of the connected masses by prestressed pressure pads. The neutralization of the weight of the pressure rods and pistons leads to shorter braking times, a higher speed for the negotiable idle-stroke distance and high closing speeds. The diaphragms which are used in this construction, for example nylon sleeves, are secured at each end by means of two O-ring seals to prevent the escape of high-pressure oil into the clamping region of the collets and pressure rods.

If an O-ring seal becomes leaky, highpressure oil flows into the clamping region uncontrollably and causes a reduced non-positive connection between the collets and the pressure rods. Collet systems of this type will not clamp in a slip-free way if, as a result of an uncontrolled film of lubricating oil, a hydrostatic film forms between the pressure rod and collet, because then the oil film cannot be broken down. In other words, the oil cannot be eliminated within the desired clamping time of approximately 0.5 to 1 second.

Normally, because of the prevailing frictional conditions a sufficient non-positive connection is provided, even under lubrication. Slipping nevertheless occurs due to such uncontrolled leakages, because a hydrostatic film is formed on which the collet will slide briefly against the pressure rod, until this hydrostatic film is forced away. When this occurs, local friction temperatures become very high, thereby causing this oil to crack with a resulting slipping over approximately 20 to 30 mm. The cracked oil settles as a coating on the pressure rods and thus leads to further uncontrolled frictional conditions. As a result, the entire system will fail, so that the press must be stopped and taken out of production.

SUMMARY OF THE INVENTION

Accordingly, it is an object of the present invention to provide on a high-speed hydraulic press a collet surface structure which eliminates oil leakage, in order to prevent a harmful hydrostatic oil film between the pressure rods and collets.

The foregoing and additional objects are attained by providing a collet surface having collet interlock for the elimination of leakage-oil which prevents penetration of the leakage-oil into the clamping region. Furthermore, the formation of a harmful hydrostatic film thickness from the lubricating-oil film between the pressure rods and the collets is prevented, since the oil is immediately forced away due to the high clamping pressure between the clamping faces. These high clamping pressures result from the extremely short space of the lubricating-oil elimination grooves and the large capacity of the grooves. Thus, since the clamping time is approximately 0.5 to 1 second, the oil-eliminating grooves are made large enough to eliminate reliably a hydrostatic oil film of at least 0.1 mm. This regularity is independent of the clamping diameter of the collet.

Advantageously, the grooves are uniformly spaced at a distance "s" of about 3.5 mm independent of the pressure-rod diameter. This spacing of approximately 3.5 mm is obtained by surface pressing of the pressure rods from a tempering steel such as 42 Cr Mo 4. The depth of each groove is approximately 0.5 mm and the width is about 1–2 mm. By means of hydraulic clamping pressure in the sleeves, the hydrostatic film is forced into the grooves until there is metallic contact between the pressure rods and the collets. The material of the collets is preferably high-strength bronze with strength values higher than those of the pressure rods. Further, the regularity of the displacement of the liquid medium is constant in relation to the oil-film thickness of approximately 0.1 mm and the displacement path s/2 of approximately 3.5/2 or less. In other words, with an increase in clamping diameter the spacing "s" need not be proportionally larger.

Generally, only when higher-tempered and surface-hardened steels are used can the spacing "s" be chosen smaller than 5.5 mm. In such a case, the hydrostatic film of approximately 0.1 mm could be displaced into the grooves in less than 0.5 seconds.

Another advantageous feature is that when leakage oil enters a leakage-oil collecting vessel through the leakage-oil elimination bores, an alarm is triggered immediately via sensors and the defective seal can be exchanged in a controlled way.

As a result of the last feature, in particular, it is possible to safeguard the press against serious damage and against a lengthy shutdown, since a check of the leakage-oil seals can be made at any time by inspecting the leakage-oil collecting vessels. If light sensors are appropriately installed, monitoring can even take place automatically by means of an electrical alarm system.

Tests have shown that, for a controlled lubrication of the collet system, only an oil quantity of limited dosage need be used, with an oil viscosity less than or equal to that of a normal hydraulic oil of approximately $0.5 \times 40$ centistokes, giving an oil-film thickness of approximately 0.01 mm.

DETAILED DESCRIPTION OF THE PREFERRED EMBODIMENTS

Figure 2:
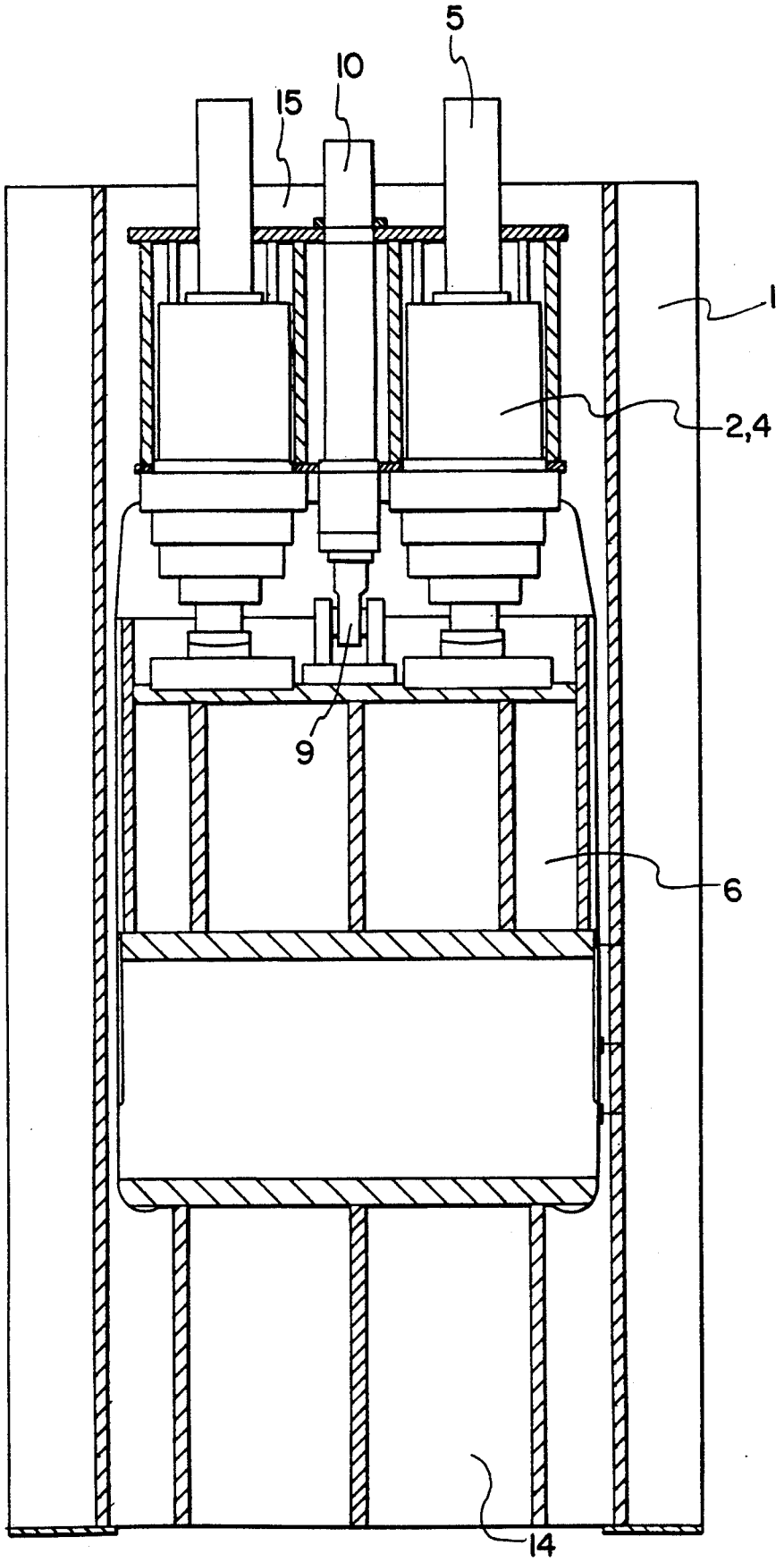
FIG. 2 is a sectional elevation view of a conventional high-speed press.

As shown in FIG. 2, the present invention is designed for use with a window-frame type hydraulic high-speed press composed of a press frame 1 with an upper crosshead 15 and a press platen 14. A press ram 6, carrying the upper mold half or female mold and raiseable and lowerable by means of the hydraulic high-speed drive 9 and 10, is arranged between the crosshead 15 and the press platen 14. The high-speed drive 9, 10 is composed of a slide 9 fastened centrally to the press ram 6 and a hydraulic cylinder/piston arrangement 10 anchored in the crosshead 15. The press ram 6 is fastened to two or four pressure rods 5, depending on the press version, which are guided in the crosshead 15. The press shown in FIG. 2 has two pressure rods 5. The oil used in the press preferably has a viscosity of less than or equal to $0.5 \times 40$ stokes.

Figure 1:
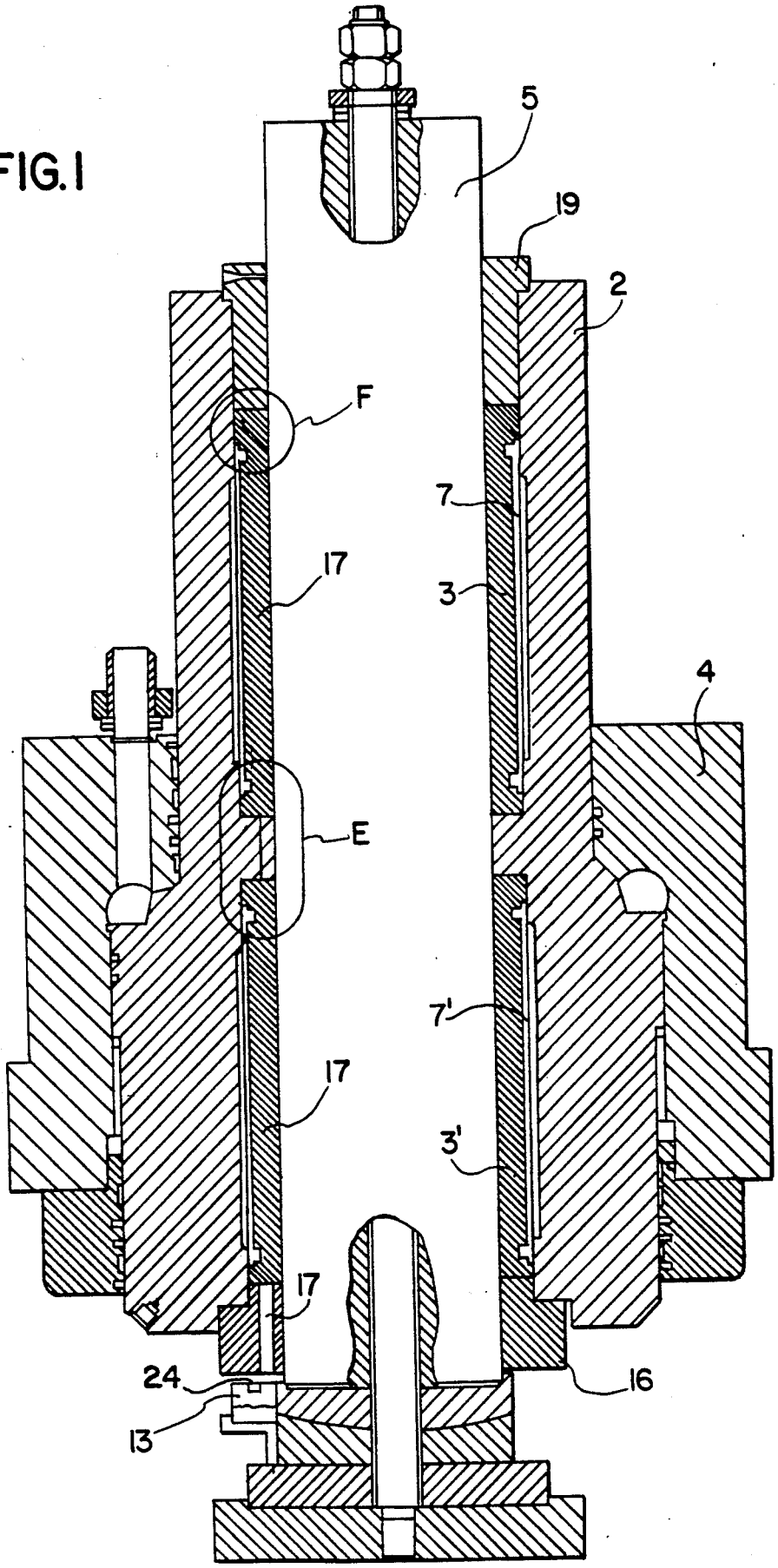
FIG. 1 is a sectional elevation view of a hydraulic collet interlock with the leakage-oil sealing according to the invention represented diagrammatically at E and F.

FIG. 1 shows, in section, the arrangement of one pressure rod 5 with an hydraulic collet interlock 3 and 7 and an hydraulic differential cylinder/piston arrangement 2 and 4 for pressing force. When pressure medium is introduced into a feed line of the press (not shown) diaphragms 7 and 7, generate pressure on collets 3 and 3', and the pressure rod 5 is interlocked non-positively with the annular piston 2 of the differential cylinder 4. Since the differential cylinders 4 are anchored in the crosshead 15, the pressure rods 5 are, therefore, also connected to the crosshead 15.

The collet interlocks—collets 3, 3' and diaphragms 7, 7'—are fastened to the pressure rods 5 and in the annular pistons 2 by means of fixing rings 16 and 19. The points E and F refer to the leakage-oil sealings and eliminations. The leakage-oil elimination bore, which is defined in the collets 3, 3', the annular pistons 2 and the fixing rings 16 and 19, is designated by 17. Leakage oil escaping when an O-ring seal becomes leaky falls or runs into the collecting vessel 13 via the leakage-oil elimination bore 17 as a result of gravity. Light sensors 24 installed on or near the collecting vessel 13 can detect the presence of fluid in vessel 13 and serve as trips for an electrical alarm system.

Figure 3A:
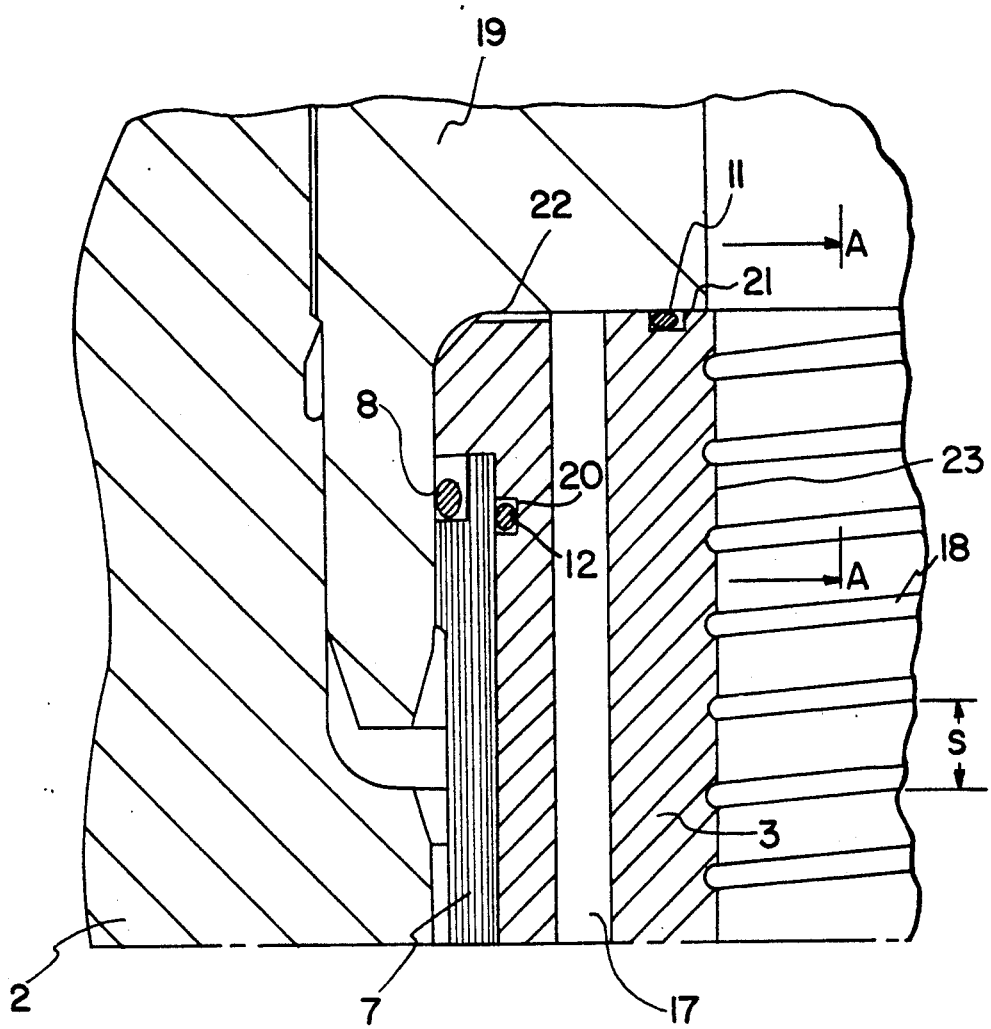
FIG. 3*a* is a detailed sectional representation of the leakage-oil sealing and elimination shown. diagrammatically at F in FIG. 1.
Figure 3B:
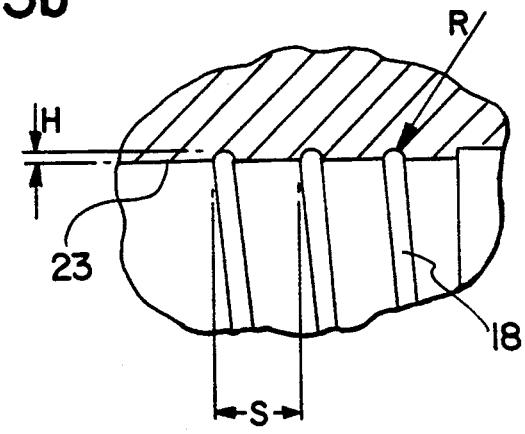
FIG. 3*b* is a detailed view, rotated through 90°, of the portion of FIG. 3*a* designated by A—A.
Figure 4:
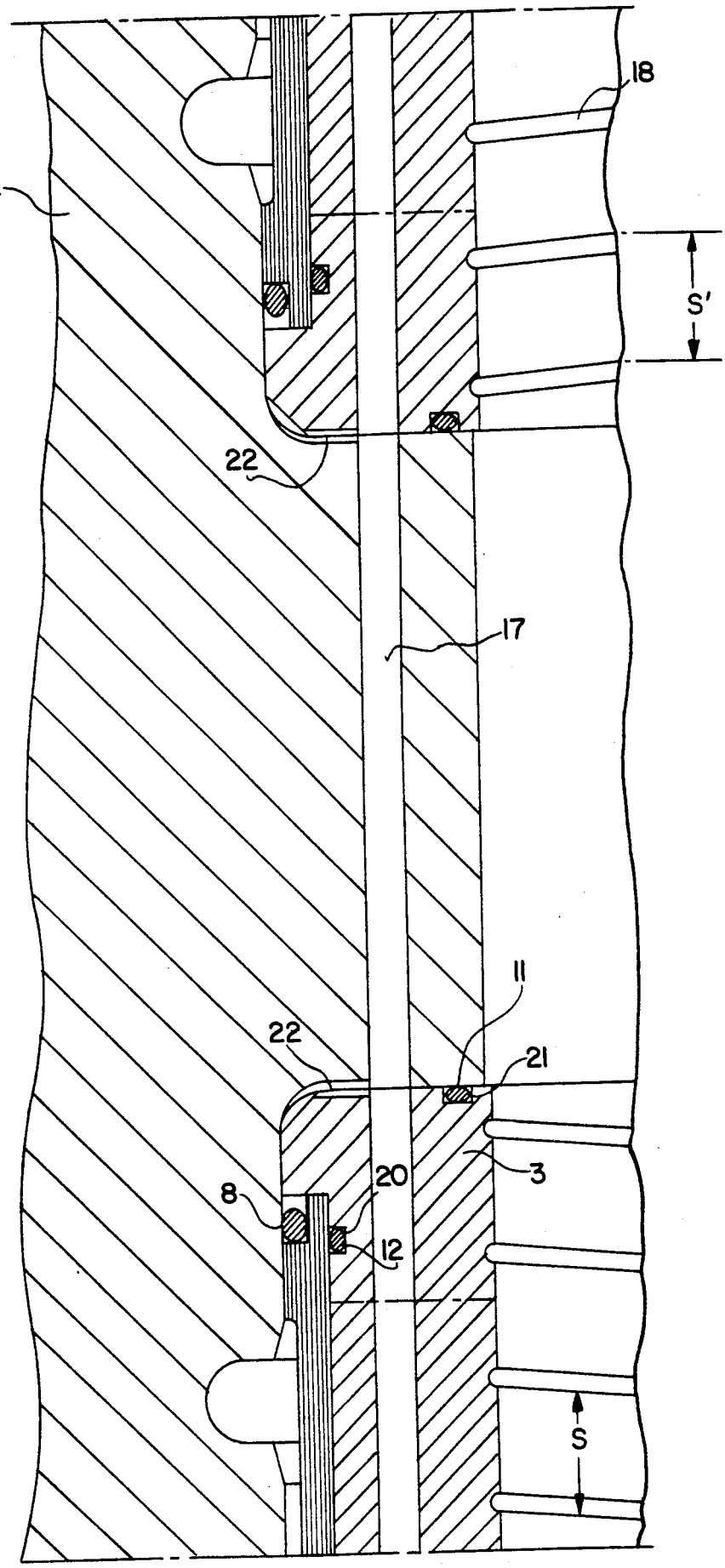
FIG. 4 is a detailed sectional representation of the leakage-oil sealing and elimination shown diagrammatically at E in FIG. 1.

Referring now to FIGS. 3 and 4, the advantageous design of the collet surface according to the invention is shown in greater detail.

To prevent an uncontrolled oil-film layer thickness larger than or equal to 0.01 mm on the outer surface of the pressure rods 5, for example as a result of uncontrolled leakages and the failure of the conventional sealing system formed by O-ring seals 8, a barrier system against leakage oil is developed through the design of the collets 3 and 3'. The O-ring seal 8 generally is in contact with the annular piston 2 or the fixing rings 16 and 19 and presses the diaphragm 7 or 7, against the collet 3 or 3' to seal the diaphragms from the clamping region According to the present invention, two further sets of O-ring seals 11 and 12 are provided which are inserted into flutes 20 and 21 on the circumference and the end faces of the collets 3 and 3'. Thus, the O-ring seal 12 shuts off escaping leakage oil from the inner slots of the collet 3 or 3', since otherwise leakage oil could flow onto collet surface 23 via the clamping slots. On the other hand, the O-ring seal 11 prevents the leakage oil from entering the inner collet diameter region in an uncontrolled way. If leakage oil nevertheless escapes in the direction of the clamping region, it first passes into the leakage-oil elimination bore 17 and then into the associated collecting vessel 13.

Due to the clamping system which is subjected to the high oil-hydraulic clamping pressure, the axial arrangement of the leakage-oil elimination bores 17 is especially important. This is because radial bores in the annular pistons 2 would otherwise lead to failure because of a high notch load.

To guard against a possible failure of the main O-ring seal 8, flow-off channels 22 are provided on the end faces of the collets 3 and 3' and/or in the mutually opposite annular faces of the annular pistons 2 or the fixing rings 16 and 19, which channels 22 eliminate the escaping leakage oil via the leakage-oil bores 17 arranged parallel to the mid-axis of the collets 3 and 3'.

Lubricating-oil elimination grooves 18 are provided to prevent, during the clamping operation, the formation of a hydrostatic film of lubricating oil or of the penetration of leakage oil into the clamping region. For this purpose, on the clamping face or collet surface 23 the spacing "s" of the lubricating-oil elimination grooves 18 formed helically in the collets 3 and 3' is calculated at 3.5 mm to be so small that the oil film is reliably drained off and forced away during the clamping operation. This spacing is obtained by surface pressing the pressure rods from a temperating steel such as 42 Cr Mo 4. As illustrated in FIG. 3B, the depth H of the grooves 18 is at least 0.5 mm and the width, being greater than or equal to twice the radius $R_1$ is preferably between about 1 and 2 mm. By means of hydraulic clamping pressure in the sleeves, the hydrostatic film is forced into the grooves until there is metallic contact between the pressure rods and the collets. The material of the collets is preferably high-strength bronze with strength values higher than those of the pressure rods. Further, the regularity of the displacement of the liquid medium is constant in relation to the oil-film thickness of approximately 0.1 mm and the displacement path s/2 of approximately 3.5/2 of less. In other words, with an increase in clamping diameter the spacing "s" need not be proportionately larger.

It should become obvious to those skilled in the art that the present invention is not limited to the preferred embodiments shown and described.

What is claimed is:

1. A collet surface structure for an hydraulic clamping system of an hydraulic highspeed press, said press comprising at least one collet disposed about a respective pressure rod of the press, a diaphragm pressing the collet against the respective pressure rod by means of pressurized fluid, and first sealing means for sealing an inner clamping region, located between said diaphragm and said pressure rod, from fluid acting on said diaphragm, said collet surface structure comprising:

a clamping face of said collet having a plurality of lubricating-fluid grooves defined therein, said grooves having a spacing of approximately 3.5 mm therebetween and a groove width of about 1 to 2 mm for a groove depth of approximately 0.5 mm, regardless of the clamping diameter of said collet;

second sealing means, provided for said collet, for preventing fluid from leaking onto said pressure rod from said collet; and said collet having at least one leakage-fluid bore defined axially therein for collecting fluid which leaks past said first sealing means from said diaphragm and onto said collet.

2. The collet surface structure according to claim 1, further comprising a collecting means for collecting leakage-fluid removed via said axial leakage-fluid bore, wherein said axial leakage-fluid bore extends continuously from said collet to said collecting means.

3. The collet surface structure according to claim 1, wherein said second sealing means comprises two O-ring seals provided respectively in annular flutes defined on a circumferential surface of each collet, said O-ring seals providing a leakage-fluid barrier relative to said collet.

4. The collet surface structure according to claim 1, wherein said second sealing means comprises two O-ring seals provided respectively in annular flutes defined on end faces of said collet.

5. The collet surface structure according to claim 2, wherein light sensing means are disposed on said collecting means for sensing leakage fluid in said collecting means for tripping an alarm.

6. The collet surface structure according to claim 1, wherein fluid flow-off channels for transferring leakage-fluid to said leakage-fluid bore from said first sealing means are defined on end faces of said collet.

7. The collet surface according to claim 1, wherein said press comprises an annular piston having mutually opposite annular faces which surround said collet, and wherein fluid flow-off channels for transferring leakage fluid to said leakage-fluid bore from said first sealing means are defined in said mutually opposite annular faces of said annular piston.

8. The collet surface structure according to claim 1, further comprising fixing rings which fasten said collet to said pressure rod, wherein fluid flow-off channels for transferring leakage fluid to said leakage-fluid bore from said first sealing means are defined in said fixing rings.

9. The collet surface structure according to claim 2, wherein said fluid is an oil with an oil viscosity less than or equal to that of a hydraulic oil of $0.5 \times 40$ stokes.

10. A high speed hydraulic press, comprising:

a press ram which carries an upper mold;

means for raising and lowering said press ram;

means for slideably guiding said press ram, said guiding means including at least one pressure rod;

means for non-positively coupling said press ram to said raising and lowering means, said coupling means operating synchronously with movement of said press ram; and means for eliminating leakage fluid, said eliminating means comprising at least one collet disposed about a respective pressure rod of the press, a diaphragm pressing the collet against the respective pressure rod by means of pressurized fluid, said diaphragm being sealed from a clamping region located between said pressure rod and said diaphragm by a seal which prevents fluid from leaking into said clamping region from said diaphragm, and a collet surface structure comprising:

1) a clamping face of said collet having a plurality of lubricating-fluid grooves defined therein, said grooves having a spacing of approximately 3.5 mm therebetween and a groove width of about 1 to 2 mm for a groove depth of approximately 0.5 mm, regardless of the clamping diameter of said collet;

2) sealing means, provided for said collet, for preventing fluid from leaking onto said pressure rod from said collet; and 3) said collet having at least one leakage-fluid bore defined axially therein for collecting fluid which leaks past said first seal from said diaphragm and onto said collet.

* * * * *